United States Patent [19]

Dueringer

[11] Patent Number: 4,679,833

[45] Date of Patent: Jul. 14, 1987

[54] CLOSURE MECHANISM FOR SUITCASES OR THE LIKE

[75] Inventor: Rudi Dueringer, Wuppertal, Fed. Rep. of Germany

[73] Assignee: S. Franzen Sohne GmbH & Co., Solingen, Fed. Rep. of Germany

[21] Appl. No.: 815,078

[22] Filed: Dec. 31, 1985

[30] Foreign Application Priority Data

Jan. 12, 1985 [DE] Fed. Rep. of Germany ..... 3500862

[51] Int. Cl.[4] ..... E05C 5/02

[52] U.S. Cl. ..... 292/113

[58] Field of Search ..... 292/DIG. 49, 113, 247, 292/106, 207; 70/73, 74, 76

[56] References Cited

U.S. PATENT DOCUMENTS

| | | | |
|---|---|---|---|
| 3,030,137 | 4/1962 | Cheney | 292/247 X |
| 3,584,906 | 6/1971 | Budzyn | 292/247 |
| 4,008,584 | 2/1977 | Wingert | 292/247 X |
| 4,074,549 | 2/1978 | Yee | 292/247 X |

FOREIGN PATENT DOCUMENTS

| | | | |
|---|---|---|---|
| 1022495 | 1/1958 | Fed. Rep. of Germany | 292/247 |
| 389123 | 9/1908 | France | 70/76 |
| 343222 | 2/1931 | United Kingdom | 70/73 |
| 559017 | 9/1977 | U.S.S.R. | 292/247 |

*Primary Examiner*—Richard E. Moore

*Attorney, Agent, or Firm*—Burns, Doane, Swecker & Mathis

[57] ABSTRACT

A closure mechanism for suitcases comprises a counter-closure part, and a closure part releasably securable to the counter-closure part. The closure part comprises a base plate and a hasp of generally U-shaped configuration including a pair of legs interconnected by a bight arranged to engage the counter-closure part. The legs define a first pivot axis about which the hasp is pivotable. A handle is pivotably mounted on the base plate for rotation toward the base plate about a second pivot axis. The handle includes first and second mutually inclined lever arms. The second lever arm carries a lift pin located below at least one of the legs of the hasp. A pair of coupling links are pivotably connected to the handle such that rotation of said handle toward a hasp-opening position causes the hasp to be rotated about the first axis by the lift pin. The links are disposed in substantially a dead center position relative to the second pivot axis when the handle is in a hasp-closing position to resist inadvertent opening of the hasp.

12 Claims, 7 Drawing Figures

4
43
H
IV
12
15
V
22
14
12
16
9
10
11
14'
2
39
4'
11
3
38
25
24
14
B
F
4'
6'
18
17
13
41
40
16
25
24
6
A
Sp
18
17

Fig. 4
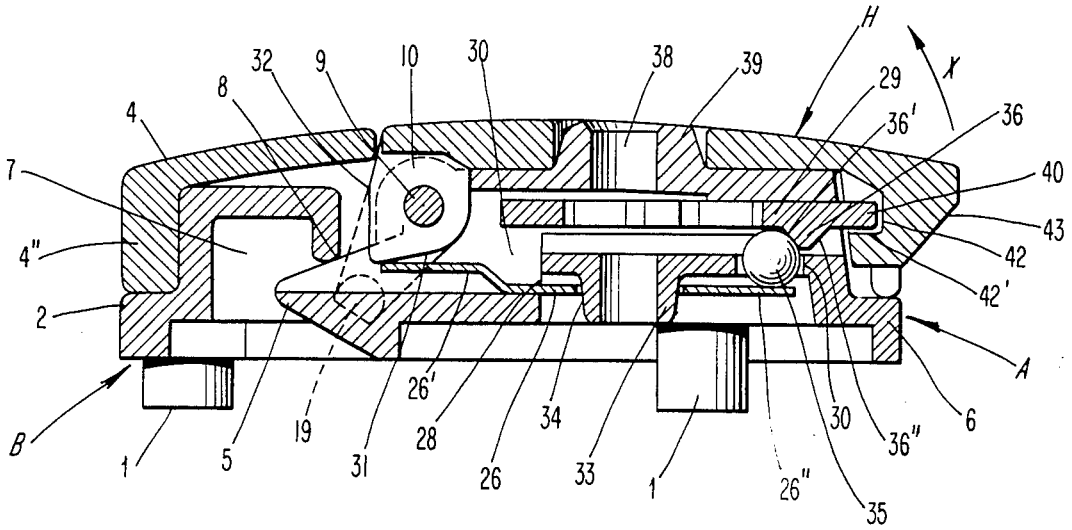
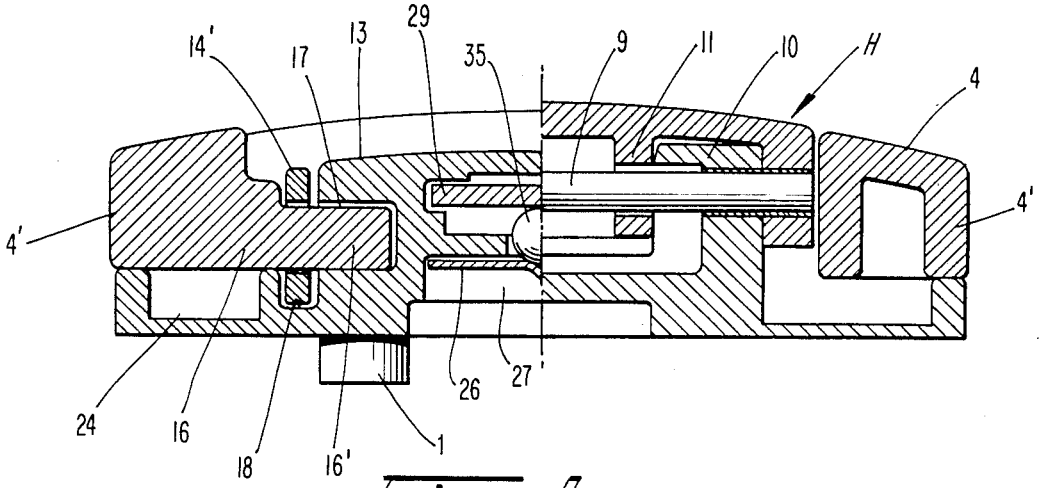
Fig. 5

CLOSURE MECHANISM FOR SUITCASES OR THE LIKE

BACKGROUND AND OBJECTS OF THE INVENTION

The invention relates to a hinged closure for suitcases, bags or the like.

Closure arrangements are known, e.g., from U.S. Pat. No. 3,584,906, wherein a closure hasp has a U-shaped configuration and surrounds a counter closure part. The hasp is supported on a base plate for swinging movement so that a portion of the hasp which engages the counter closure part moves horizontally and vertically away from the latter. Such movement of the hasp is effected by means of an operating handle pivotably mounted on the base plate and connected to the hasp by means of coupling straps. Pivot pins connecting the straps with the hasp are displaceable linearly with respect to the base plate. The closure hasp is secured positively in its closed position by the straps being oriented in a dead center position. Also, a lock can be effected by a key-operated locking bolt which prevents biasing of the hasp.

When the handle is swung to an open position, the hasp is swung by means of a cam mounted on the base plate, which cam cooperates with a control surface on the underside of the hasp. In such an arrangement, a substantial portion of the rotation of the handle (e.g., 83° of 90°) is required to bring the hasp into engagement with the cam. Thus, only 7° of the handle rotation remains for the raising of the closure hasp to pivot it away from the counter closure part. Also, the control surface is relatively steep, so that a relatively high opening force may be required; thus, the bearing points of the moving parts are stressed more severely.

It is an object of the invention to develop a hinged closure of this generic type that is simple to produce, easy to operate and improved in function.

Summary of the Invention

These objects are achieved by the present invention which relates to a closure mechanism for suitcases or the like. The closure mechanism comprises a counter closure part, and a closure part securable to the counter closure part. The closure part includes a base plate upon which a hasp is disposed. The hasp is of generally U-shaped configuration and includes a pair of legs interconnected by a bight. The bight is arranged to engage the counter closure part. The legs each carry a connector arranged for linearly displacement relative to the base plate and defining a first pivot axis about which the hasp is pivotable to move the bight toward and away from the base plate. A handle is pivotably mounted on the base plate for rotation toward the base plate about a second pivot axis to a closing position and away from the base plate toward an opening position. The handle includes first and second mutually inclined lever arms. The first lever arm is longer than the second lever arm and is manually engageable for pivoting the handle. The second lever arm carries a lift pin located below at least one of the legs of the hasp. A pair of coupling links are each pivotably connected to the handle and to one of the connectors so that rotation of the handle toward the opening position causes the connectors to be linearly displaced by the links, and further causes the hasp to be rotated about the first axis by the lift pin. The links are each disposed in substantially a dead center position relative to the second pivot axis when the handle is in its closed position, in order to resist inadvertent opening of the hasp.

As a result of this configuration, a hinged closure of the above-mentioned generic type having significant advantages is obtained, primarily an improved ease of operation. The closure hasp is lifted positively and directly by the actuating handle. This takes place on a curved pivoting track and because of the use of a shorter lever arm there is a favorable lever action. The longer lever arm is available as a relatively large and easily grippable actuating handle. The provision of two arms does not lead to a longer configuration of the double arm actuating handle. The lift pins are provided on the conventional handle legs; no additional parts have been provided to carry the lift pins. The pins are readily molded laterally onto the actuating handle. For balanced actuation, both legs of the closure hasp may be pushed from below, for which two correspondingly coaxial lift pins are provided; lifting takes place in the terminal phase of the pivoting motion of the actuating handle, i.e., in the last third of that motion.

The closed position may be maintained securely. This does not require a locking penetration of the base plate. Rather, the positive locking of the closure hasp is obtained by a hasp arm extending past the closure hasp link pin, which enters a position parallel to a locking shoulder formed by the top side of the fastening base plate. This further results in simpler injection molding molds; it is even possible to operate without a cross slide. Exposed guide strips are avoided. This also facilitates the finishing of the basic structural parts. The forming of the closure hasp arm again requires no additional increase of the closure hasp. The configuration involved here is based on a variation of the point of the application of articulation to the closure hasp. The insertion recess extending from the locking shoulder may easily be taken into account in the injection molding process. As the result of the fact that the closure hasp arm is wider than the insertion recess and the immersing segment of the closure hasp arm is in the form of a narrower projection, advantageous lateral guidance of the free hasp ends is obtained, which are connected merely by means of the coupling links with the actuating handle. Their escape from the insertion recess is not disadvantageous in the closed position, as by means of the web of the hasp a high supporting rest on the counter closure part is used; it is closed in itself with respect to the force systems. Furthermore, the actuating handle immerses fully into the inner space of the hasp, thereby providing lateral support. Movements without catching are obtained simply by the pins pivoting in the fastening base plate in a groove. In this manner, an optimum length of the short lever arm may be utilized, with the groove and the notches contributing to the savings in material. The coupling links are also guided in an optimum manner. The heads on the closure hasp side of the coupling links protrude into grooves of the fastening base plate, while the link pins of the closure hasp move in lateral guide grooves of a center socket covered by the actuating handle. The fastening base plate is thus doubly utilized for the guidance of the moving parts of the closure. The position of the center socket favors its configuration as a closure housing, for example, a key actuated locking bolt. The corresponding area is further utilized insofar as a flat spring is located in the center socket, which both serving to secure the terminal positions of the locking bolt and acting with a segment which projects from the center socket in the direction of the counter-closure part and the camming surfaces of the actuating handle, which in the terminal positions of the actuating handle are abutting flat against the flat spring section. The flat spring thus performs a dual function by simple means. Their coordination is attained simply, without the use of conventional fastening elements, by that the flat spring is secured in its position with a hole/pin joint. The pin may be included in the injection molding process.

THE DRAWINGS

The objects and advantages of the invention will become apparent from the following detailed description of a preferred embodiment thereof in connection with the accompanying drawings in which like numerals designate like elements, and in which:

FIG. 5 depicts line V—V in FIG. 1;

Figure 1:
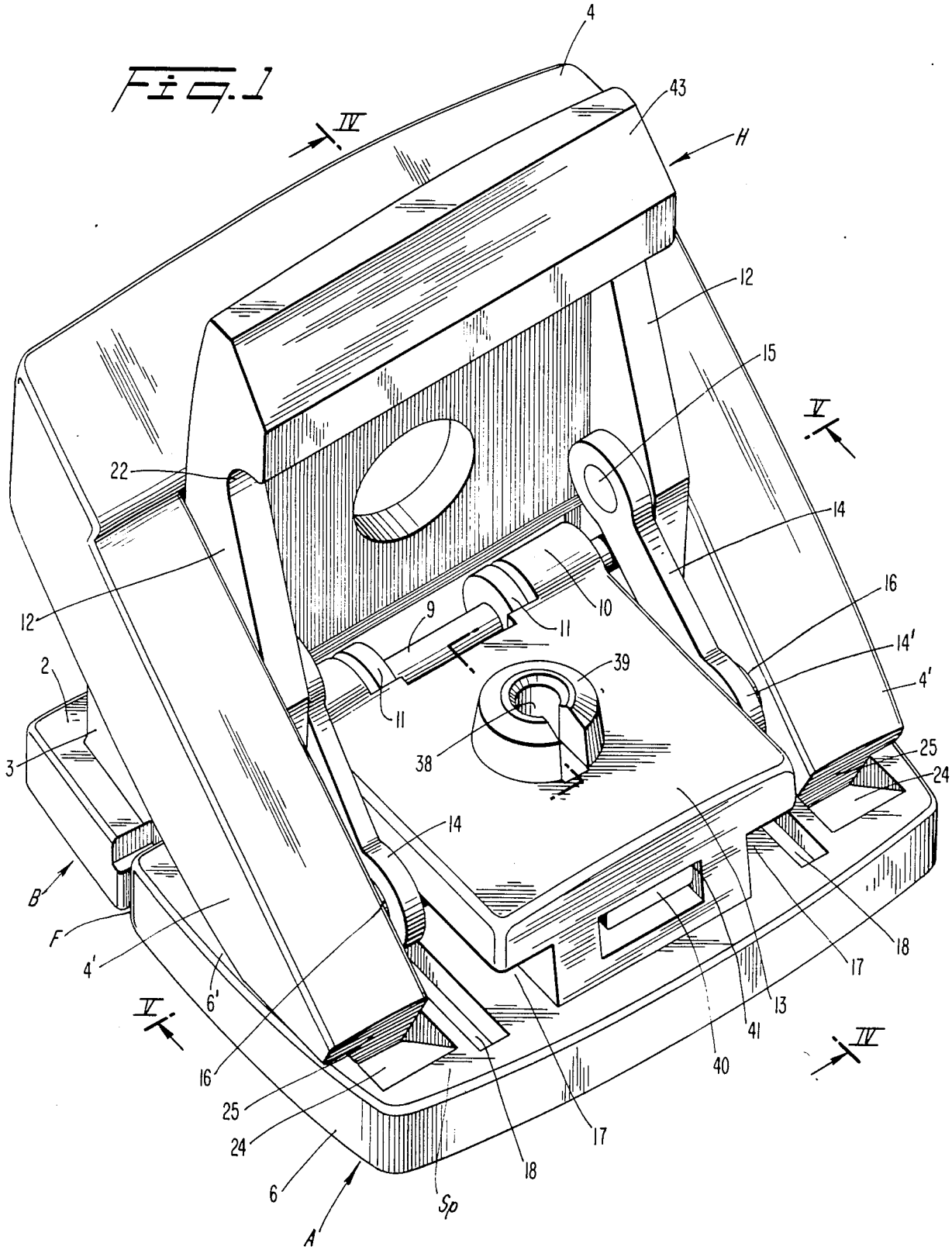
FIG. 1 depicts a hinged closure according to the invention in a perspective view, in the open position.
Figure 1A:
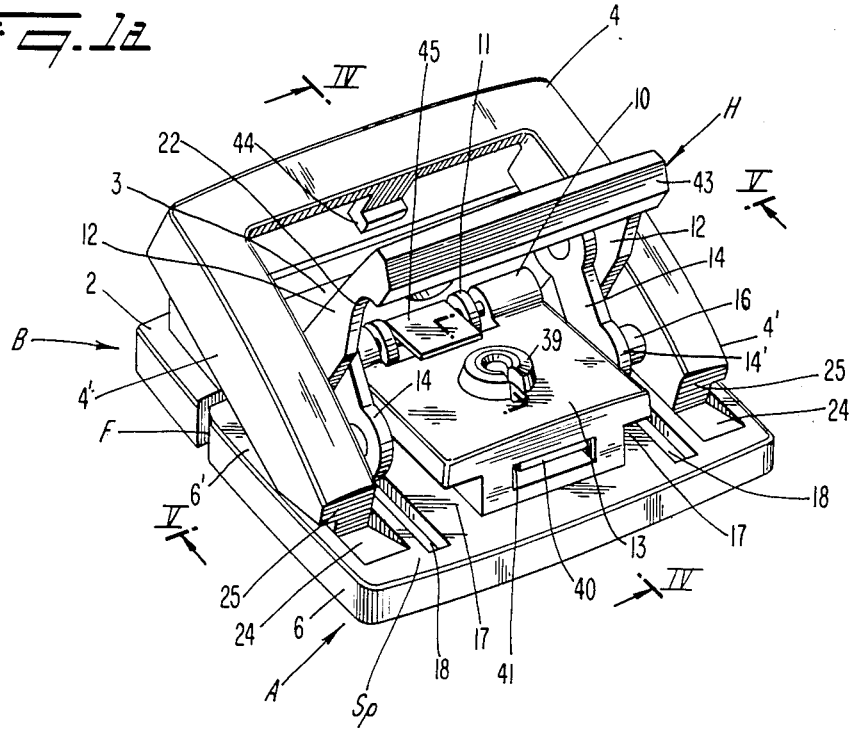

FIGURES 1*a* to 4*a* are similar to FIGS. 1 to 4, respectively, and depict another embodiment of the invention.

DETAILED DESCRIPTION OF A PREFERRED EMBODIMENT OF THE INVENTION

The hinged closure shown consists of a closure part A, and a counter closure part B. The counter closure part B is located on the lid of the suitcase and the closure part on its bottom part, or the like.

These parts A, B are fastened by means of hollow rivets or threaded sleeves molded onto the support side.

The counter closure part B comprises a base plate 2 shaped as an elongated rectangle. A ledge 3 disposed atop the plate 2 is gripped by a U-shaped closure hasp 4 of the closure part A. In so doing, the closure hasp 4 draws counter closure part onto a nose 5 which projects from an integral base plate 6 of the closure part A. The nose 5 is designed as a wedge-like projection and engages a recess 7 of the counter-closure part B (FIG. 4). The wedge surfaces of the nose 5 thereby cooperate with guiding edges 8 of the recess. The narrow sides of the nose may also converge in the direction of insertion, whereby additionally a lateral centering of the positions of the parts A, B is obtained.

The closure hasp 4 includes a pair of legs 4′ and an interconnecting bight 4″ which form a U-shape that encompasses the counter-closure part B. Each of the legs 4′ includes a contact surface 4‴ which in the preferred embodiment is defined by a lower edge of the respective leg. The hasp 4 is supported displaceably on the fastening base plate 6 and may be pivoted transversely to the plane of this fastening base plate, i.e., it may be raised from the base plate, by an actuating handle H. The latter has the configuration of a double lever and is supported on the base plate 6. A pivot axle 9 of the handle H extends near the nose 5 and runs parallel to a gap F between base plates 6 and 2. Bearing lugs 10 are formed on the fastening base plate 6, and bearing lugs 11 are formed (molded) integrally on the handle H and within a cavity defined by the handle H. That cavity of the handle opens toward the fastening base plate 6. The arrangement of the bearings lugs 10, 11 is such that they are located as close to the end of the bearing axle 9 as possible, while a space is provided between the outer ends of the bearing lugs 10 and the angled walls 12 of the actuating handle H. In the pivoting direction of the actuating handle H the bearing lugs are continuing into a center table or socket 13 which projects over the fastening base plate 6. The latter is gripped in the closed position by the cap-like actuating handle H in a mostly invisible manner.

In spaces located between the inner sides of the walls 12 and the outer sides of the center socket 13, a pair of coupling links or strips 14 are arranged. At one end each link is pivotably connected to the handle H by means of a link pin 15 integral with the link. The other end of each link is pivotably connected with the free ends of the U-legs 4′ of the closure hasp by means of a connector or link pin 16 which is integral with the respective leg 4′ (see FIG. 5). The link pin 15 lies along a first lever arm a (FIG. 3) of the double arm actuating handle H at a position closer to the bearing axle 9 than to the free end of the actuating handle (approximately in the first fifth of the distance from the axle 9 to the end of the handle). The terminal section 16′ of the link pin 16 disposed in the link 14 is of reduced cross-section. A collar section of the pin 16 situated between the link and the wall 12 is of greater cross-section, preferably greater than the thickness of the wall 12. The section 16′ extends beyond the thickness of the coupling links 14 (FIG. 5) and travels in lateral guide grooves 17 of the center socket 13. The parallel guide grooves 17 include bottoms defined by the top side 6′ of the fastening base plate 6. The grooves 17 lie in a plane extending beneath the bearing axle 9 of the actuating handle H. In addition to this horizontal guidance for the heads 14′ of the coupling links 14 provided by the grooves 17, a further guidance in the axial direction of the link pins 16 is further provided by means of grooves 18 situated parallel to each other on the top side 6′ of the fastening base plate 6. The length of the grooves 18 is in accordance with the stroke required for the linear motion of the link pins 16.

A second lever arm b of the dual arm actuating handle H (shorter than the first lever arm a) extends between the axis of the axle 9 and a pair of lift pins 19 projecting laterally from the walls 12. The pins 19 project under the U-legs 4′ of the U-shaped closure hasp 4. The two lever arms a, b form an included obtuse angle $\alpha$ of approximately 135°. When the handle H is being pivoted, the pins 19 travel within grooves 20 formed in the top side 6′ of the fastening base plate and located within the movement path of the pins. In the closing position of the closure hasp (FIG. 4), the depth of immersion therein comprises approximately the pin diameter. In this manner, the closure hasp 4 has its bottom side lying flushly on the top sides of the base plates 6 and 2 which top sides are located at a common elevation.

The distance between the center of the bearing axle 9 and the center of the pins 19 corresponds essentially to the distance between the bearing axle 9 and the center of the link pins 15, the latter forming the connection between the actuating handle H and the coupling links 14.

A further measure to provide an extremely flush arrangement and support of the actuating handle H on the top side of the fastening base plate 6 involves the provision of a pair of immersion grooves 22 formed in the cap walls 12. The grooves 22 are located in a frontal edge of these walls and are arranged in accordance with the superimposed movement path of the link pins 16. Thus, the grooves 22 receive the pins 16 when the closure is closed.

Figure 2A:
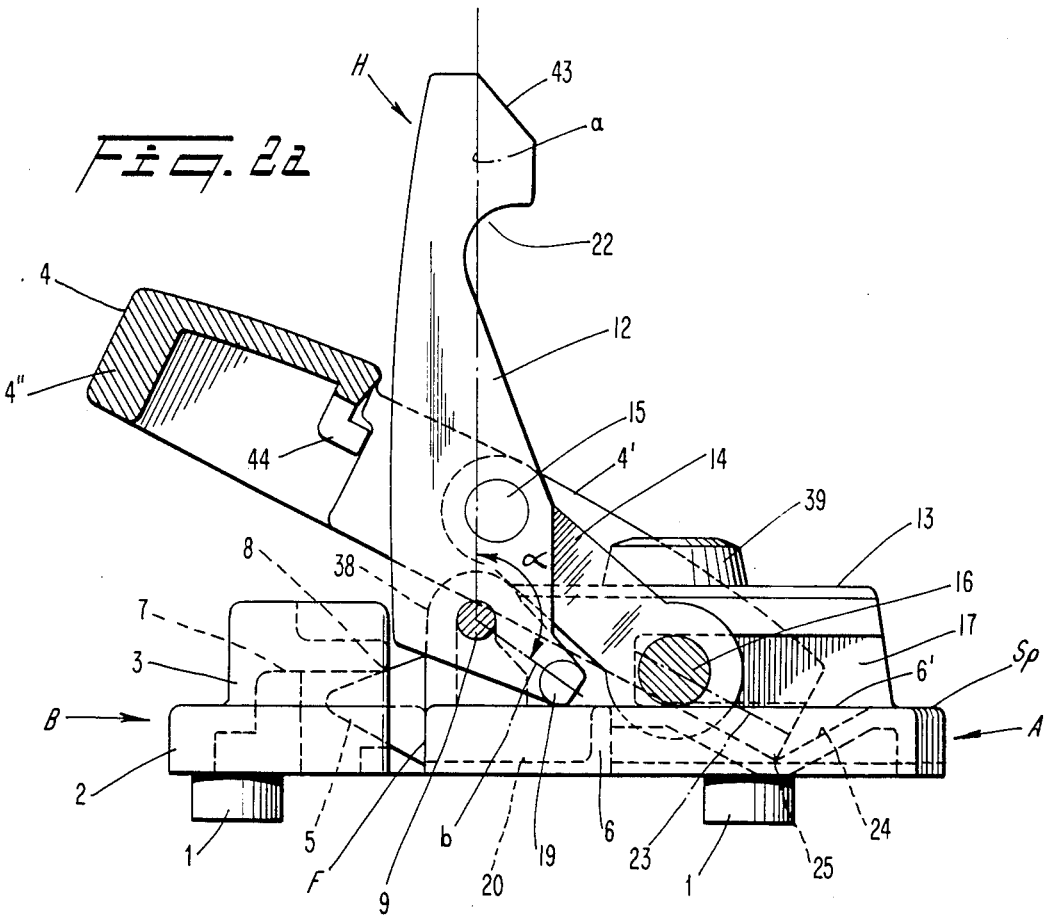
FIG. 2 is a lateral view of FIG. 1 with the closure hasp shown in cross-section.
Figure 2:
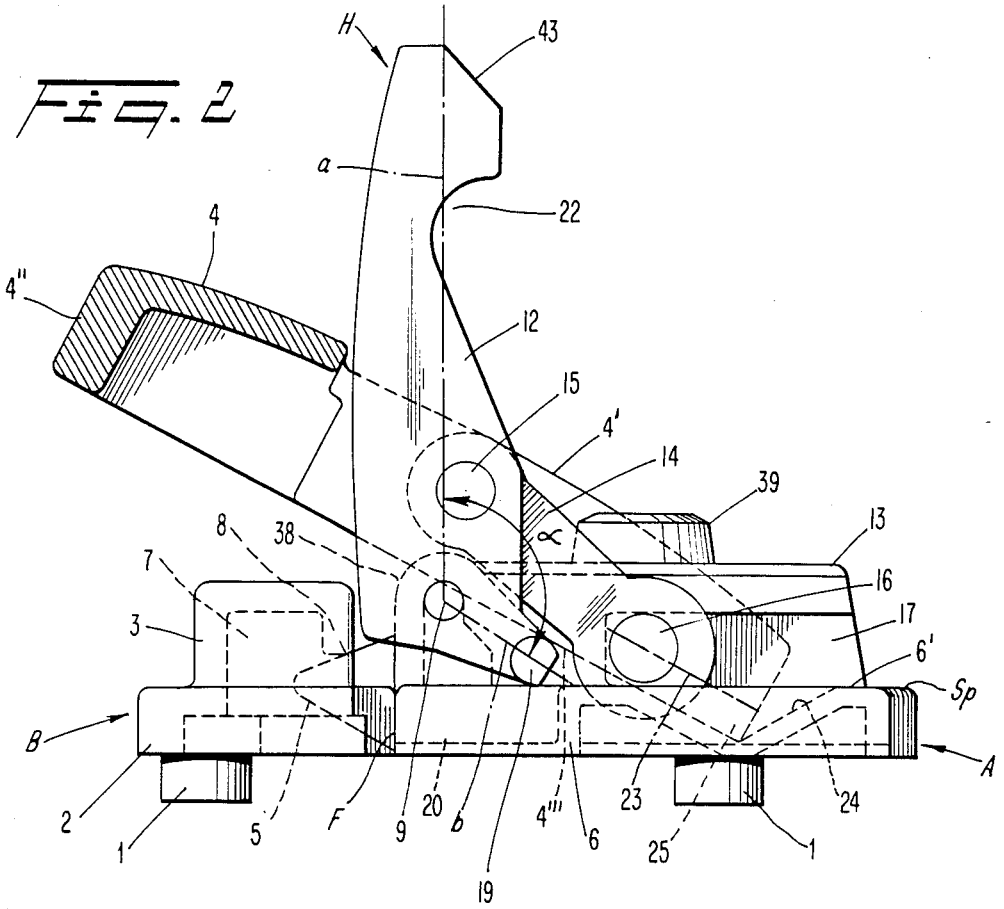

The link pins 16 engage the closure hasp 4 at d distance from the free ends of the legs 4' of the closure hasp 4. As a result, an extension segment 23 (FIG. 2) of each leg 4' projects beyond the link pin 16 of the closure hasp. The bottom side of such segment 23 occupies, in the closed position of the hinged closure, a position parallel to the top side 6' of the fastening base plate 6. Upon the upward pivoting of the closure hasp 4, on the other hand, the segment 23 partially enters a groove 24 of the fastening plate 6 (FIG. 2). The top side 6' forms a locking shoulder Sp (FIGS. 1, 2) which lies adjacent the insertion groove 24 in the top side 6'. The bottom side of the segment 23 rests upon the locking shoulder Sp when the closure is in a closed position. In that closed position, the coupling links 14, are in a dead center position (i.e., the pivots 9, 15, 16 are substantially colinear), which safely excludes the possibility that an upward movement of the closure hasp 4 could occur which would lead to the opening of the hinged closure. Rather, opening may be effected only by the upward motion of the actuating handle H in the direction of the arrow x.

The external sides of the closure hasp legs 4' are aligned flushly with the external sides of the fastening base plate 6 as viewed in FIG. 5. In order to insure good guidance of the ends of the closure hasp legs, the closure hasp segment 23 is wider than the width of the insertion groove 24 and the segment 23 which enters the groove 24 is in the form of a projection 25. The corresponding wedge-shaped recess of the external residual segment extends to the height of the link pin 16.

The groove 24 and the groove 18 entending parallel to it in its immediate vicinity are separated from each other by a partition of the fastening base plate 16. From a function standpoint, however, there is no objection to connecting the grooves 18, 24 directly with each other.

Figure 7:
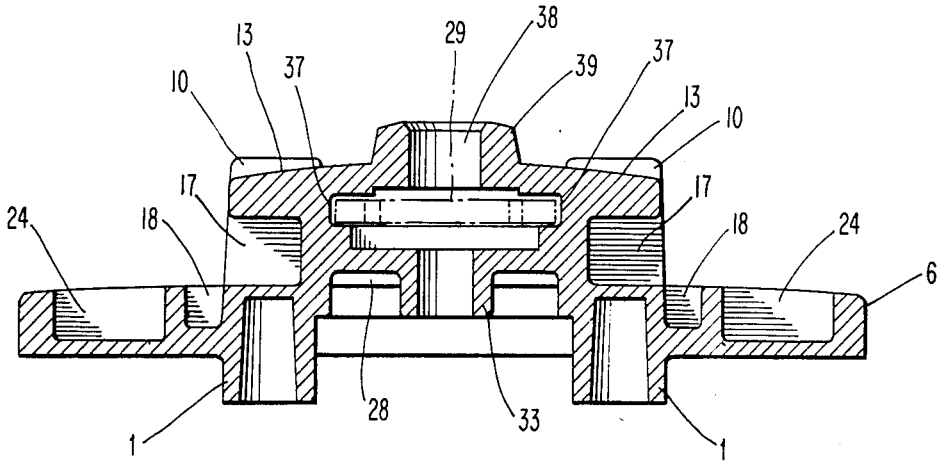
FIG. 7 depicts line VII—VII of FIG. 6.

Both terminal positions of the actuating handle H are defined and maintained under an over-ridable spring force. The spring involved is located in the form of a flat spring 26 (FIG. 4) mounted in a recess 27 which opens downwardly on the bottom side of the fastening base plate 6. The flat spring 26 is supported laterally on walls of the recess 27 and a chamber 30 containing a locking bolt 29. The spring extends near camming surfaces 31 and 32 of the actuating handle 4. A portion of a terminal segment 26' of the flat spring 26 emerging from the window 28 rests on the bottom of the chamber 30 and is under a certain pre-stress. Another portion of the terminal segment is spaced from the bottom of chamber 30. The two locking surfaces 31 and 32 are located at an angle of slightly less than 90° to each other and define a pair of cams in the pivotable area of the closure hasp. In order to obtain a further fixation of the flat spring, the spring is fastened to the center socket 13 by a hole/pin joint 34, 33. The pin 33 extends integrally from a bottom section of the chamber 30 which is offset upwardly in the form of a step. The pin projects into the recess 27 and through the hole 34 in the spring. The hole is of a size to permit an adequate vertical play of the spring. The other terminal section 26'' of the spring pushes upwardly against a ball 35 which is supported on the top side of the spring. The ball is located in a recess 30' of the chamber bottom and bears against the locking bolt 29. In the locking position of the bolt 29, the ball bears elastically against one flank 36' of a cam 36 formed onto the bottom side of the locking bolt 29. In the open position of the locking bolt 29, the ball bears against another flank 36'' of the cam 36. When the locking bolt 29 moves, the cam 36 passes over the ball 35 and pushes the ball downwardly against the force of the flat spring 26. The vertical displacement is of an extent such that the ball cannot escape from its cage formed by the recess 30'. The locking bolt 29 is guided in longitudinal groovers 37, as clearly seen in the sectional view of FIG. 7. Thus, the ball 35 locks the locking bolt 29 in its locking and unlocking positions.

Located within the locking bolt are control projections adapted to be engaged by a key. The projections are aligned with a key channel 38. The latter is located in a bushing 39 extending above the center socket 13, which, for accessibility, passes through a center opening in the cover of the actuating handle H (FIG. 4). The top of the bushing 39 is flush with an upper surface of the handle H.

The locking bolt 29 is displaceable with respect to the fastening base plate 6 and has a locking tongue 40 at its end. The latter passes through a lock opening 41 (FIG. 1) in the socket 13. The opening 41 is aligned with a locking pocket 42 in the free end of the actuating handle H (FIG. 4). The tongue 40 thus overlies a shoulder 42' of the pocket 42 when the locking bolt is in a locking position. To ease the flipping upward of the actuating handle H, its free end is undercut at 43.

Figure 3:
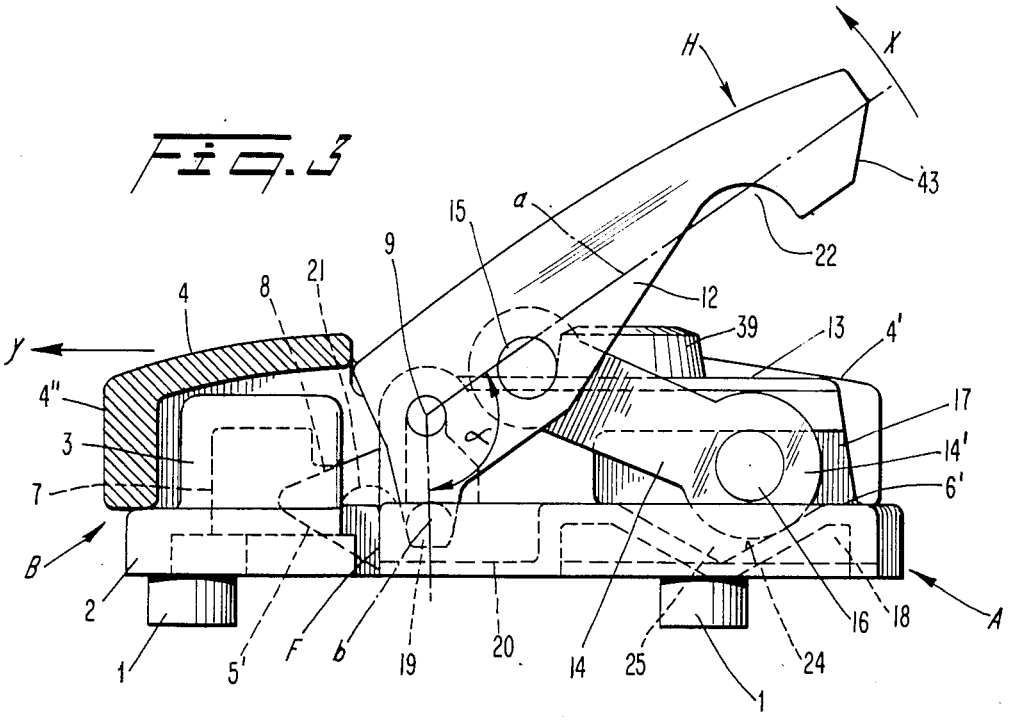
FIG. 3 is a view corresponding to FIG. 2 in an intermediate position.
Figure 3A:
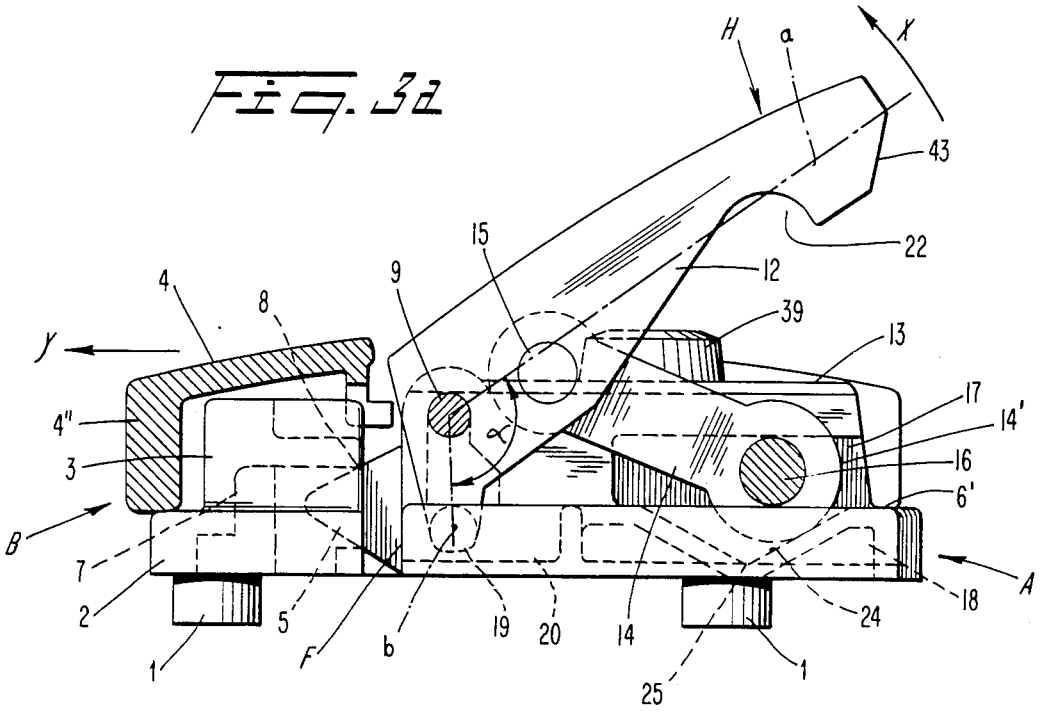

The mode of operation of the hinged closure is as follows. To open the closure, the locking bolt 29 is displaced rearwardly (i.e., to the left in FIG. 4) by a key. Thus, the locking tongue 40 releases the actuating handle H. The latter is manually swivelled upwardly in the direction of the arrow x around the pivot axle 9 (FIG. 4). The U-shaped closure hasp 4 is thereby initially pulled linearly in the horizontal direction on the fastening base plate 6 in the direction of the arrow y (FIG. 3). This occurs due to the forces exerted upon the pins 16 by the coupling links 14. The segments 23 of the hasp 4 move out of the area of the locking shoulder Sp. As the handle H is rotated farther, the pins 19 of the handle H engage the bottom sides of the U-legs 4' (FIGS. 3–4), thereby pivoting the rear end of the closure hasp 4 upwardly, so that its bight 4'' releases the counter closure part B. As that occurs, the segments 23 enter the grooves 24. The closure part A and the counter closure part B may now be separated from each other. The open position is maintained by the effect of the flat spring 26. Closing is effected in reverse order. The closing part A and the counter closing part B are brought into abutment against each other to close the gap simply by closing the lid of the suitcase. In the process, the nose 5 engages the pocket-like recess 7 of the counter closure part B. This results in the centering of the parts A, B. The actuating handle H is then pivoted opposite the direction of the arrow x. The upward forces acting on the closure hasp are withdrawn by the immersion of the pins 19 into the groove 20. The hasp 4 engages the ledge 3 of the part B. The coupling links 14, which now act as pusher elements, move the closure hasp in a direction opposite to the arrow y. In the terminal phase, the segment 23 engages the locking step Sp, the links enter the self-locking dead center position. The hinged closure may now be locked.

Figure 4A:
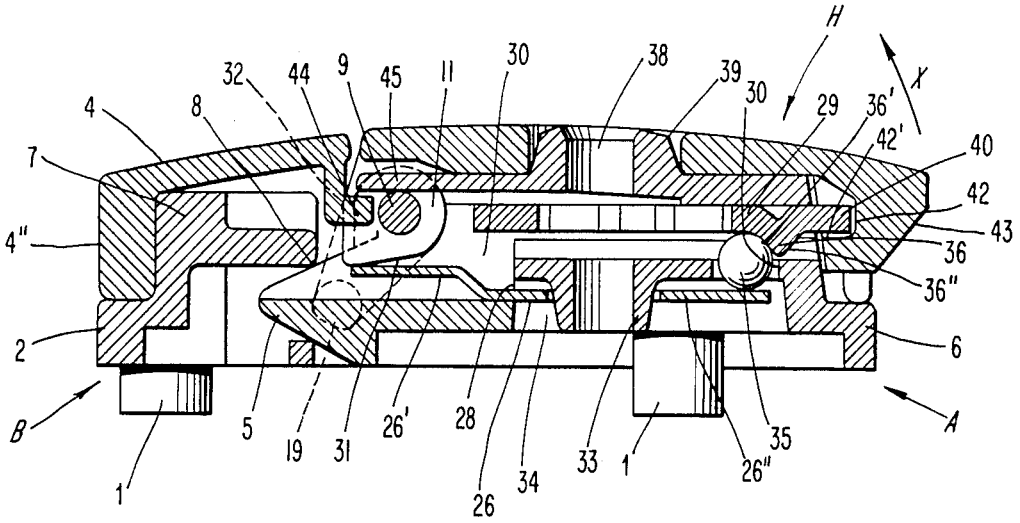
FIG. 4 depicts line IV—IV of FIG. 1 in longitudinal section, but in the closed position.
Figure 6:
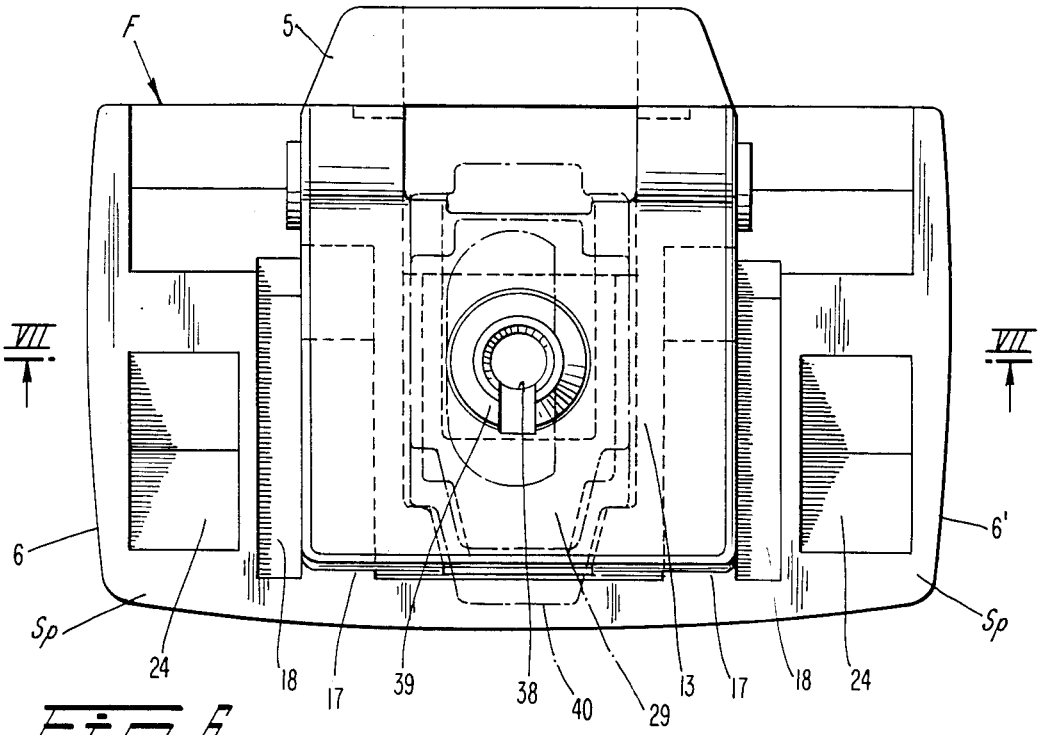
FIG. 6 depicts a top view of the fastening plate individually with the locking bolt.

Another preferred embodiment of the invention is depicted in FIGS. 1*a* to 4*a*. The closure part A depicted therein is basically similar so that disclosed earlier herein and common elements are provided with identical reference numerals. There is further provided, however, a hook 44 which depends from the bight portion 4″ of the hasp. A flange 45 is mounted on the center socket 13 and extends therefrom in such manner that when the hasp is closed, the hook extends beneath the flange, as depicted in FIG. 4*a*. As a result, the hasp is more secure in its closed position, i.e., inadvertent opening is resisted, because movement of the hasp away from the base plate is possible only if the handle 41 is raised. Also, undesired play of the hasp in the closed position is reduced by the hook.

Although the present invention has been described in connection with a preferred embodiment thereof, it will be appreciated by those skilled in the art that additions, modifications, substitutions, and deletions not specifically described may be made, without departing from the spirit and scope of the invention as defined in the appended claims.

What I claim is:

1. A closure mechanism for suitcases or the like, comprising:

a counter-closure part, and a closure part securable to said counter-closure part, said closure part comprising a base plate, a hasp of generally U-shaped configuration including a pair of legs interconnected by a bight, said bight arranged to engage said counter-closure part, said legs each carrying a connector arranged for linear displacement relative to said base plate and defining a first pivot axis about which said hasp is pivotable to move said bight toward and away from said base plate, at least one of said legs including a contact surface, a handle pivotably mounted on said base plate for rotation toward said base plate about a second pivot axis to a closing position, and away from said base plate toward an opening position, said handle including first and second mutually inclined lever arm means, said first lever arm means being longer than said second lever arm means and being manually engageable for pivoting said handle, said second lever arm means carrying lift pin means located below at least one of said legs extending into underlying relationship with said contact surface of said hasp, and a pair of coupling links each pivotably connected to said handle and one of said connectors such that rotation of said handle toward said opening position causes said connectors of said hasp to be linearly displaced by said links, and causes said hasp to be rotated about said first axis by engagement of said lift pins with said contact surface.

2. A closure mechanism according to claim 1, wherein said hasp legs each include an extension segment extending beyond the associated one of said connectors, said base plate including a top surface, portions of which defining coplanar stop surfaces against which said extension segment bears when said handle is in said closing position, a pair of immersion grooves disposed in said top surface adjacent said stop surfaces and arranged to receive said extension segments when said handle is moved to said opening position.

3. A closure mechanism according to claim 1, wherein said base plate includes a top surface, said top surface including groove means within which said lift pin means travels during pivoting of said handle.

4. A closure mechanism according to claim 1, wherein said links each being pivotably connected to said legs by a pivot pin, said links each including a head carrying said pivot pin, said base plate includes a top surface, said top surface including a pair of grooves in which said heads travel during rotation of said handle, a center table extending upwardly relative to said top surface and including a pair of lateral guide grooves extending parallel to said top surface, said pivot pins extending into respective ones of said guide grooves for guiding said heads in linear movement.

5. A closure mechanism according to claim 1, including a locking bolt movably mounted in said table and being engageable with said handle for locking same against pivotal movement.

6. A closure mechanism according to claim 4, including a leaf spring mounted in said table, said spring including a first end arranged to exert yieldable forces against said locking bolt to constrain the latter in locking and unlocking positions, said spring including a second end arranged to exert yieldable forces against a portion of said handle to create resistance to opening and closing of said handle.

7. A closure mechanism according to claim 6, wherein said table includes a projection extending from a bottom surface of said table, said spring including a hole through which said projection extends.

8. A closure mechanism according to claim 1 including a flange connected to said base plate, and projecting therefrom, and said hasp including a hook arranged to sit beneath said flange in said closing position.

9. A closure mechanism according to claim 1, wherein said contact surface comprises a lower edge of said at least one leg.

10. A closure mechanism according to claim 1, wherein said lift pin means extends laterally relative to the direction of pivotal movement of said handle.

11. A closure mechanism according to claim 1, wherein each of said legs includes said contact surface, said lift pin means comprising a pair of lift pins extending laterally relative to the direction of pivotal movement of said handle so as to underlie respective ones of said contact surfaces.

12. A closure mechanism according to claim 1, wherein each of said links is disposed in substantially a dead center position relative to said second pivot axis when said handle is in said closing position, to resist inadvertent opening of said hasp.

* * * * *